US006457407B2

(12) United States Patent
Leib et al.

(10) Patent No.: US 6,457,407 B2
(45) Date of Patent: Oct. 1, 2002

(54) METHOD AND APPARATUS FOR ADJUSTING CYLINDERS IN A PRINTING MACHINE

(75) Inventors: Rodolf Leib; Günter Stephan, both of Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/740,635

(22) Filed: Dec. 18, 2000

(30) Foreign Application Priority Data

Dec. 16, 1999 (DE) ..... 199 60 730

(51) Int. Cl.[7] ..... B41L 9/10
(52) U.S. Cl. ..... 101/145; 101/247
(58) Field of Search ..... 101/145, 137, 101/139, 140, 144, 143, 182, 184, 185, 209, 351.1, 351.2, 351.3, 351.4, 352.01, 352.02, 352.03, 352.04, 352.05

(56) References Cited

U.S. PATENT DOCUMENTS 3,903,795 A * 9/1975 Suzuki ..... 101/409
4,495,863 A * 1/1985 Despot et al. ..... 101/350
4,523,522 A * 6/1985 Fischer ..... 101/219
5,503,075 A * 4/1996 Matsuo et al. ..... 101/477
6,325,322 B1 * 12/2001 Lewis ..... 242/538.2

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

A method for adjusting a cylinder in a printing machine includes, in a first step, rotating a first cylinder into a rotary position wherein a cylinder gap formed in the first cylinder is directed towards a second cylinder of the printing machine and, in a second step, displacing one of the two cylinders, with the second cylinder dipping into the cylinder gap; and a printing machine for performing the method.

11 Claims, 2 Drawing Sheets

METHOD AND APPARATUS FOR ADJUSTING CYLINDERS IN A PRINTING MACHINE

BACKGROUND OF THE INVENTION

Field of the Invention

The invention relates to a method for adjusting cylinders in a printing machine, and to a printing machine suitable for performing the method.

Modern in-line sheet-fed offset rotary printing machines include a plurality of offset printing units and often a varnishing or lacquering unit downline from the offset printing units, and are thus set up as effectively as possible for the widest possible variety of printing jobs. Many of the printing jobs, although indeed requiring print carrier sheets to be printed in the printing units, do not need any varnishing of the sheets in the varnishing unit. The applicator cylinder of the varnishing unit is therefore thrown off from the impression cylinder for the printing jobs. In this adjustment of the applicator cylinder from a print-on position into a print-off position, a printing nip formed by the cylinders is opened slightly. When the sheets are being transported through this slightly opened printing nip, there is a risk that the sheets transported past the applicator cylinder on the impression cylinder will engage or impact the applicator cylinder, with the result that fresh ink applied to the sheets in the printing units becomes smeared onto the applicator cylinder.

It is therefore desirable for the printing nip between the impression cylinder and the applicator cylinder to be capable of being enlarged to such an extent that there is no longer any risk of the sheets impacting the applicator cylinder. This desire is often obstructed, however, by the fact that various components are arranged in the immediate vicinity of the applicator cylinder, such as, for example, the impression cylinder, a supply roller for supplying ink or varnish to the applicator cylinder, a blower for guiding the sheets, a washer for cleaning the applicator cylinder and a varnish bath or tub for storing the varnish printed by the applicator cylinder, and impede wide-ranging displacements of the applicator cylinder. Consequently, as a rule, it is possible for the applicator cylinder to be displaced out of the print-on position thereof into the print-off position thereof only over a short distance, with the result that the clearance between the applicator cylinder and the impression cylinder is not large enough.

In order to overcome this problem and prevent the sheets from impacting the inactive applicator cylinder, various possibilities are conceivable, some of which are explained briefly hereinbelow.

A first possibility would involve a simultaneous midpoint displacement of the applicator cylinder and the supply roller away from the impression cylinder, so that the printing nip is enlarged to a sufficient extent. However, a relatively complex adjustment mounting would be necessary for coupling the applicator cylinder to the supply roller in order to maintain permanent bearing contact of the applicator cylinder with the supply roller during the simultaneous displacement.

A second possibility would involve withdrawing away from the applicator cylinder, those components, such as the varnish bath or tub, the washer, and the blower, for example, which block the sufficiently wide displacement of the applicator cylinder, so that the applicator cylinder can be pivoted coaxially to the supply roller, in a direction of rotation corresponding to the direction of rotation of the impression cylinder during the transport of the sheets, into the free space resulting from the withdrawal. However, not every printing machine has sufficient free space for the withdrawal of the aforementioned components, and the bearing supports necessary for withdrawing the components are relatively costly.

A third possibility would be to remove the applicator cylinder not required for the current in-line process from the varnishing unit, so that the print carrier printed in the offset printing units can run through the varnishing unit without difficulty. However, a selective operation of the printing machine without the applicator cylinder presupposes specific constructive conditions. So that, with the applicator cylinder removed from the printing machine, the gearwheel arranged coaxially with the applicator cylinder for rotatively driving the latter can remain integrated as an intermediate wheel in a gear train of the printing machine, it is necessary to have a coupling for decoupling the applicator cylinder from the gearwheel remaining in the printing machine, and for coupling the applicator cylinder to the gearwheel when the latter is subsequently reinserted into the printing machine. For example, the coupling for separating and connecting an axle journal or kingpin could be arranged on this axle journal at the drive-side end of the applicator cylinder. After the separation of the axle journal, a journal part thereof, together with the gearwheel seated on this journal part and with a roller bearing for rotating the applicator cylinder, the journal part being inserted into the roller bearing, remains in the printing machine, while the applicator cylinder, together with the other journal part, can be removed from the printing machine. A coupling half of the coupling is located on each of the two journal parts. In order mutually to couple and decouple two journal parts of an applicator-cylinder axle journal arranged at the operating-side end of the applicator cylinder, a further coupling would be necessary. Thus, with the applicator cylinder removed, a journal part of the operating-side axle journal, together with an operating-side roller bearing of the applicator cylinder, could also remain in the printing machine.

It would therefore be necessary for the axle journals of the applicator cylinder to have a coupling constructed in a manner similar to that of the axle journals of a numbering shaft described in the published German Patent Document DE 34 07 681 C2. The coupling thereof is formed of a halfshell, a clamping jaw and a clamping screw/bayonet lock and is illustrated in FIG. 4 of this reference.

Although the construction outlay resulting from the coupling for the applicator cylinder would possibly yet be justifiable, it would be necessary, because of the great weight of the applicator cylinder, to have, in order to remove it, a pivoting device which would be constructed in accordance with the pivoting device identified by the reference numeral 20 in the just-mentioned published German patent document, and the construction thereof would therefore be too complicated.

In order to prevent the sheets transported past the applicator cylinder by the impression cylinder from impacting the applicator cylinder, there is, in addition to the three possibilities explained above, a fourth possibility which is described in the published German Patent Document DE 197 19 624 C1, which describes a method for adjusting a cylinder, wherein a cylinder gap of the applicator cylinder thrown off from the impression cylinder is oriented in a manner that the cylinder gap is directed towards the impression cylinder, with the result that an enlarged interspace is produced between the cylinders. Moreover, a sheet guide element is arranged in the cylinder gap, in order to press the sheets onto the impression cylinder. In order to integrate the sheet guide element into the cylinder gap, sufficient free space is required in the latter, which is generally not available, because blanket tensioners arranged in a cylinder gap take up a very large amount of construction space for themselves.

SUMMARY OF THE INVENTION

It is accordingly an object of the invention, therefore, to provide a method for adjusting a cylinder, by which an applicator cylinder can be adjusted in an uncomplicated manner to a sufficiently enlarged clearance relative to an impression cylinder, and to provide a printing machine by which the method can be performed, without requiring a sheet guiding element in the cylinder gap of the applicator cylinder.

With the foregoing and other objects in view, there is provided, in accordance with one aspect of the invention, a method for adjusting a cylinder in a printing machine, which comprises, in a first step, rotating a first cylinder into a rotary position wherein a cylinder gap formed in the first cylinder is directed towards a second cylinder of the printing machine and, in a second step, displacing one of the two cylinders, with the second cylinder dipping into the cylinder gap.

In accordance with another mode, the method of the invention includes, in the second step, pivoting the second cylinder out of a first cylinder position located outside the cylinder gap, through the cylinder gap, and into a second cylinder position located outside the cylinder gap.

In accordance with a further mode of the method invention, in the second step, the pivoting of the second cylinder takes place coaxially with an axis of rotation of a supply roller.

In accordance with an added mode of the method invention, the first cylinder is an impression cylinder, and the second cylinder is an applicator cylinder.

In accordance with an additional mode, the method of the invention includes, in the second step, displacing the first cylinder in a direction towards the second cylinder.

In accordance with yet another mode of the method invention, the first cylinder is an applicator cylinder, and the second cylinder is a supply roller.

In accordance with another aspect of-the invention, there is provided a printing machine including an impression cylinder formed with a cylinder gap, and an applicator cylinder for applying ink or varnish onto a print carrier transported on the impression cylinder, comprising a bearing support whereon the applicator cylinder is mounted for displacing the applicator cylinder into the cylinder gap, and out of the cylinder gap again into a clearance position wherein it is disposed with a clearance relative to the impression cylinder.

In accordance with a further feature of the invention, the bearing support is formed as a pivot bearing for pivoting the applicator cylinder coaxially with a rotational axis of a supply roller for supplying ink or varnish to the applicator cylinder.

In accordance with an added feature of the invention, the bearing support is formed as a pivot bearing for pivoting the applicator cylinder about the pivot bearing into a clearance position in a rotational direction which, as viewed in the same viewing direction, is opposite to a rotational direction of the impression cylinder during the transport of the print carrier by the impression cylinder.

In accordance with an additional aspect of the invention, there is provided a printing machine including an applicator cylinder for applying ink or varnish to a print carrier and, a supply roller for supplying the ink or varnish to the applicator cylinder, comprising a first bearing support whereon the applicator cylinder is mounted for displacing the applicator cylinder in a direction towards the supply roller, and a second bearing support whereon the supply roller is mounted for holding the supply roller in a fixed position during the displacement of the applicator cylinder.

In accordance with yet another feature of the invention, the printing machine includes a securing device assigned to the applicator cylinder for retaining the applicator cylinder in a rotary position wherein a cylinder gap formed in the applicator cylinder is directed towards the supply roller.

In accordance with yet a further feature of the invention, the first bearing support is formed as a linear guide.

In accordance with yet an added aspect of the invention, there is provided a printing machine for performing a method of adjusting a cylinder therein, which includes, in a first step, rotating a first cylinder into a rotary position wherein a cylinder gap formed in the first cylinder is directed towards a second cylinder of the printing machine and, in a second o step, displacing one of the two cylinders, with the second cylinder dipping into the cylinder gap, the printing machine including an impression cylinder formed with a cylinder gap, and an applicator cylinder for applying ink or varnish onto a print carrier transported on the impression cylinder, and comprising a bearing support whereon the applicator cylinder is mounted for displacing the applicator cylinder into the cylinder gap, and out of the cylinder gap again into a clearance position wherein it is disposed with a clearance relative to the impression cylinder.

In accordance with a concomitant aspect of the invention, there is provided a printing machine for performing a method of adjusting a cylinder therein, which includes, in a first step, rotating a first cylinder into a rotary position wherein a cylinder gap formed in the first cylinder is directed towards a second cylinder of the printing machine and, in a second step, displacing one of the two cylinders, with the second cylinder dipping into the cylinder gap, the printing machine including an applicator cylinder for applying ink or varnish to a print carrier and, a supply roller for supplying the ink or varnish to the applicator cylinder, and comprising a first bearing support whereon the applicator cylinder is mounted for displacing the applicator cylinder in a direction towards the supply roller, and a second bearing support whereon the supply roller is mounted for holding the supply roller in a fixed position during the displacement of the applicator cylinder.

If, as aforementioned, a displacement of the first cylinder takes place in the second step, the cylinder gap formed in the first cylinder is slipped over the second cylinder which, without being itself displaced, can thus penetrate into the cylinder gap of the first cylinder. As a result of the displacement of the first cylinder, the latter can be adjusted out of the initial position thereof into a new position axially parallel to the initial position of the first cylinder.

If the displacement of the second cylinder takes place in the second step, the second cylinder is moved into the cylinder gap of the first cylinder, without requiring a displacement of the latter. As a result of the displacement of the second cylinder, the latter can be adjusted out of the initial position thereof into a new position axially parallel to the initial position of the second cylinder.

The first or the second cylinder displaced in the second step is preferably a printing-machine applicator cylinder which, as a result of the displacement thereof, is set at an enlarged circumferential surface clearance relative to an adjacent impression cylinder.

An advantage arising from the method according to the invention is that, at minimum outlay, a printing nip between the applicator cylinder and the impression cylinder can be set, so that, during the transport of a freshly printed or varnished print carrier sheet through the printing nip by the impression cylinder, there is no risk of the sheet impacting the applicator cylinder and consequently becoming smeared.

A first printing machine according to the invention, which is particularly advantageous for carrying out the method and is of uncomplicated construction, and which has an impression cylinder with a cylinder gap, and an applicator cylinder for applying ink or varnish to a print carrier transported onto the impression cylinder is distinguished by an applicator cylinder bearing support, by which the applicator cylinder can be displaced through the cylinder gap into a position with a clearance relative to the impression cylinder.

Thus, by the bearing support thereof, the applicator cylinder can be displaced in the following sequence out of an initial position into the cylinder gap, through the cylinder gap, out of the cylinder gap and into the clearance position and also in the opposite direction out of the clearance position into the cylinder gap, through the cylinder gap and back into the initial position. The printing machine is advantageous with regard to a gapless construction of the applicator cylinder. For example, a blanket sleeve or printing form sleeve for printing or varnishing may be slipped onto a cylinder core of the applicator cylinder. However, the first printing machine according to the invention is also advantageous with regard to a construction of the applicator cylinder with a cylinder gap which is built up with fittings, such as, for example, clamping and tensioning devices for holding a blanket or a printing or varnishing plate, which reach almost-as far as the circular-arcuate circumferential line (ideal in the region of the cylinder gap) of the applicator cylinder. Examples thereof are a fitting projecting out of the cylinder gap of the applicator cylinder or the sleeve of that part of the applicator cylinder which is moved through the cylinder gap of the impression cylinder during the displacement of the applicator cylinder.

A second printing machine according to the invention, which is likewise particularly advantageous for carrying out the method and is of uncomplicated construction, and which has an applicator cylinder for applying ink or varnish to a print carrier, and a supply roller for supplying ink or varnish to the applicator cylinder, is distinguished by a first bearing support and a second bearing support, the first bearing support being assigned to the applicator cylinder, in order to guide the applicator cylinder during the displacement thereof in a direction towards the supply roller, and the second bearing support being assigned to the supply roller, in order to retain the latter in a fixed position during the displacement of the applicator cylinder in a direction towards the supply roller.

The second printing machine is advantageous with regard to the cylinder gap of the impression cylinder being highly confined by fittings, such as, for example, tongs-type grippers and gripper supports for holding a print carrier sheet, where a movement of the, applicator cylinder through the cylinder gap is not possible, in contrast with the first printing machine. In the second printing machine, in a cylinder gap of the applicator cylinder, there can be sufficient free space for the penetration of the supply roller into the last-mentioned cylinder gap, between clamping and tensioning devices for holding a blanket or a printing or varnishing plate on the applicator cylinder. Thus, the supply roller of the second printing machine may have a gapless construction, as is customary.

Other features which are considered as characteristic for the invention are set forth in the appended claims.

Although the invention is illustrated and described herein as a method for adjusting a cylinder, and a printing machine for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
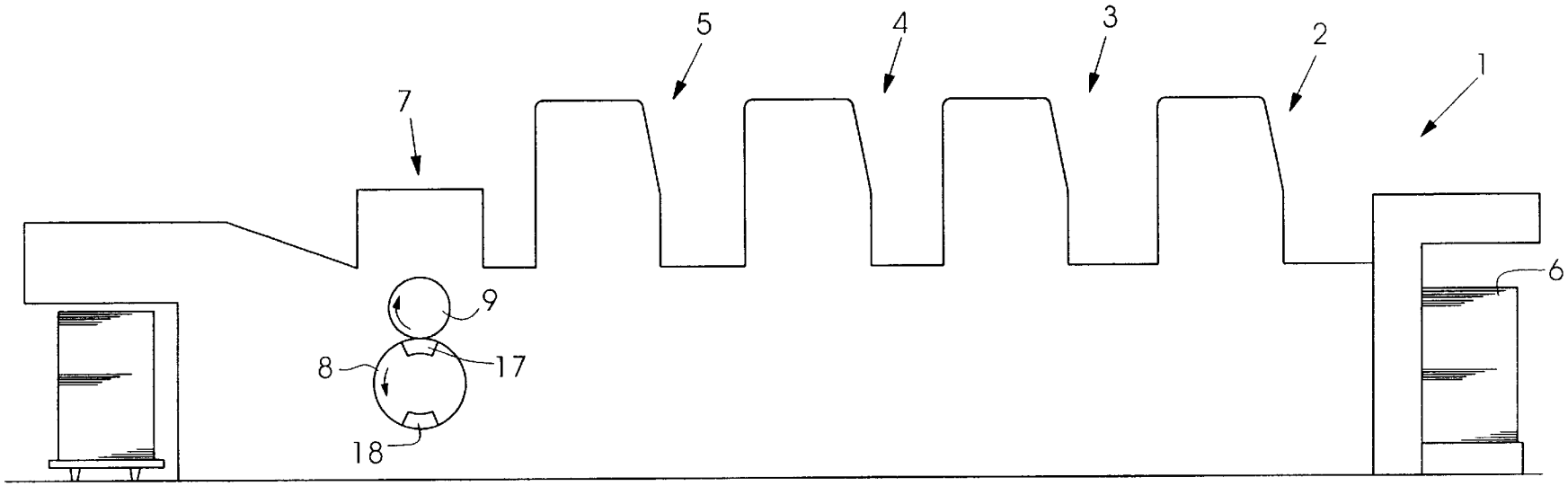
FIG. 1 is a diagrammatic side elevational view of a sheet-fed rotary printing machine with several offset printing units, four in number in the illustrated embodiment, and with a varnishing unit disposed downline therefrom in the sheet transport direction from the righthand side to the lefthand side of the figure.
Figure 2:
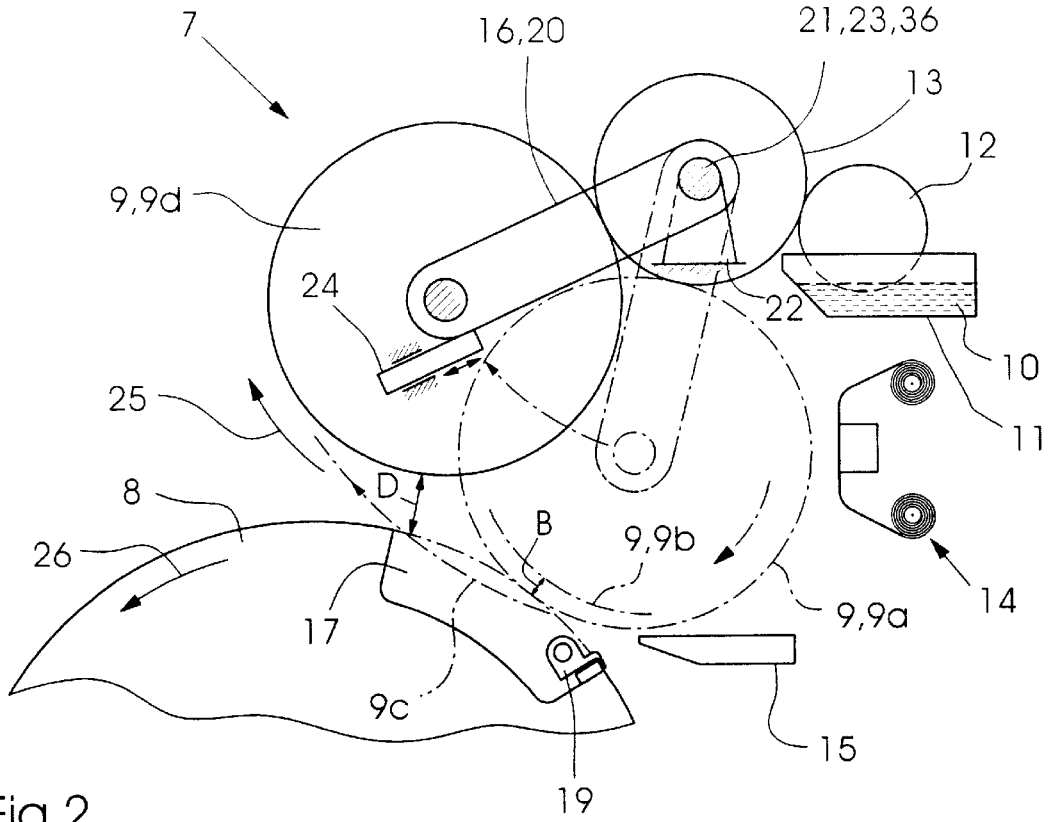
FIGS. 2 and 3 are enlarged fragmentary views of FIG. 1 showing in greater detail a first and a second exemplary embodiment, respectively, of the varnishing unit according to the invention.
Figure 3:
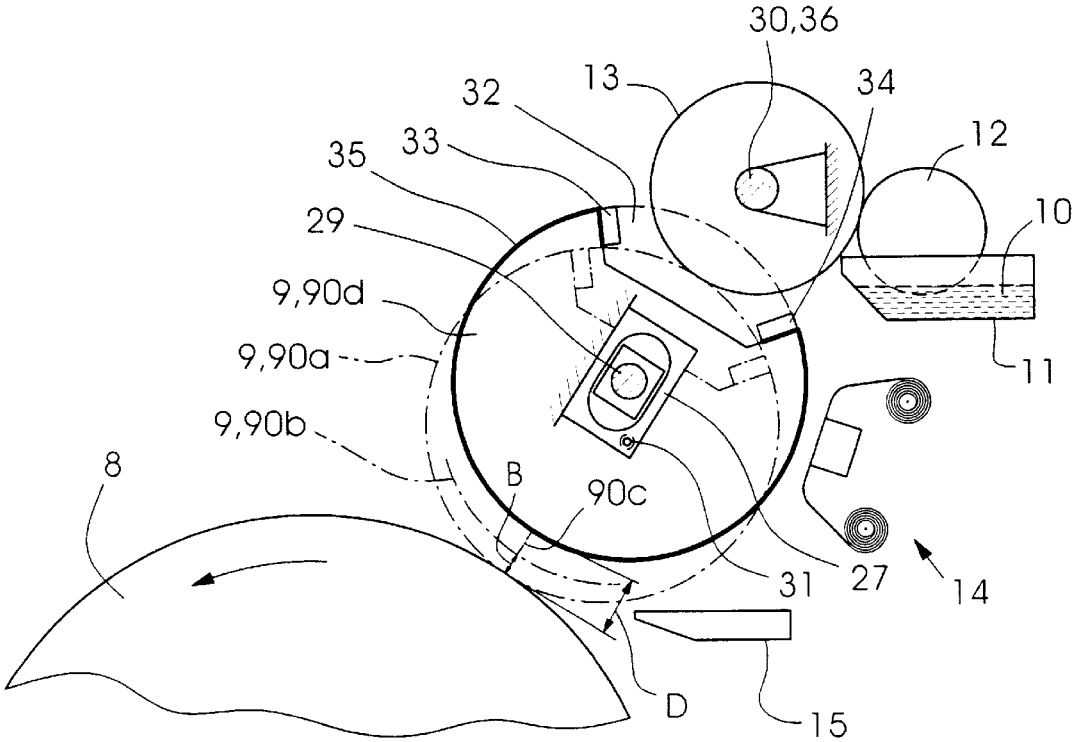

Referring now to the drawings and, first, particularly to FIG. 1 thereof, there is illustrated therein a rotary printing machine 1 with at least one offset printing unit 2 to 5 for printing a sheet-like print carrier 6. The printing machine 1 includes a varnishing unit 7 located downline of the at least one printing unit 2 to 5 in the transport direction of the print carrier 6, into which an ink may, of course, also be introduced instead of a varnish. The unit 7 includes a conventionally double-sized impression cylinder 8 and an applicator cylinder 9 for applying varnish to the print carrier 6 which, at the same time, runs through a printing nip between the cylinders 8 and 9. As shown in FIGS. 2 and 3, the varnish 10 is held in a storage trough or bath 11 and is scooped out of the latter by a dipping roller 12 arranged in the bath 11. In rolling contact with the roller 12 and the cylinder 9 is a supply roller 13 which is rotatable about a rotational axis 36 and transfers the varnish onto a flexographic printing form tension-mounted on the cylinder 9, for spot varnishing, or onto a blanket tension-mounted on the cylinder 9, for full-surface varnishing and, together with the roller 13, generates a varnish film.

With respect to the transport direction of the print carrier through the machine 1 from the righthand to the lefthand sides of FIGS. 1 to 3, the roller 13 bears against the cylinder 9 in the region of the first quadrant of the latter, and the cylinder 9 bears against the cylinder 8 in the region of the first quadrant of the latter.

Adjacent the cylinder 9, a cleaning device 14 for washing the cylinder 9, and a sheet guide 15 for pressing the print carrier 6 onto the cylinder 8 are arranged. The sheet guide 15 extends reaches into a wedge of a printing nip formed by and between the cylinders 8 and 9 and located on the entry side of the print carrier, and is formed as a blowing or blasting device provided with nozzles directed onto the cylinder 8. The cleaning device 14 is arranged below the bath 11 and includes a strip-like cleaning cloth wound on a winding roller and being pressable onto the cylinder 9.

The cylinder 9 is adjustable by an otherwise non-illustrated print-on and print-off setting device into a print-on setting 9*a* wherein it is in bearing contact against the print carrier 6 resting on the cylinder 8, and into a print-off setting 9*b*with a slight clearance B relative to the cylinder 8. The cylinder 8 has at least one circumferential cylinder gap 17, 18 wherein grippers 19 for holding the print carrier 6 are arranged, the cylinder gap 17, 18 extending over the length of the body of the cylinder 9 in a direction axially parallel to the cylinders 8 and 9.

The unit 7 may be constructed in accordance with the exemplary embodiment shown in FIG. 2 or, alternatively, according to the exemplary embodiment shown in FIG. 3, the preceding description of FIGS. 1 to 3 applying in the same way to both exemplary embodiments, and the exemplary embodiments being described hereinbelow individually.

In the exemplary embodiment shown in FIG. 2, the cylinder 9 is displaceable by a bearing support 16 out of the print-on setting or position 9*a*, along a travel path 9*c* of the cylinder 9 extending through the cylinder gap 17 of the cylinder 8, into a clearance position 9*d* with a clearance D relative to the cylinder 8. The clearances B and D are measured in the direction of a median line running through centers of rotation of the cylinders 8 and 9. The bearing support 16 is formed, in each case, of a pivoting lever 20 and a rotary joint 21 at each end of the cylinder 9. The lever 20 is pivotable about the joint 21 which is arranged coaxially to a rotary joint 23 which is fastened fixedly to a stand 22 of the machine 1, the roller 13 being rotatable about the rotary joint 23, and the position of the rotational axis 36 being determined thereby. The cylinder 9 is rotationally mounted in the lever 20 and, during the pivoting of the lever 20 about the joint 21, remains circumferentially in permanent bearing contact on the roller 13.

The exemplary embodiment shown in FIG. 2 functions as follows:

Initially, the cylinder 8 is oriented so that the cylinder gap 17 and the cylinder 9 are located opposite one another. The cylinder 8 is oriented by an electric motor of the machine 1 via a gearwheel transmission connecting the cylinder 8 to the electric motor. After the cylinder 8 has reached that rotary position wherein the cylinder gap 17 is directed towards the cylinder 9, the electric motor is stopped. Thereafter, due to the friction in the gearwheel transmission, the cylinder 8 maintains the rotary-angle position thereof set by the motor.

After the orientation of the cylinder 8, the cylinder 9 is pivoted by the lever 20 about the joint 21 out of an initial position, which may be the print-on position 9*a* and is preferably the print-off position 9*b*, clockwise with respect to FIG. 2 away from the devices 14 and 15. This pivoting may be effected manually or preferably by an actuating drive coupled to the lever 20. During the pivoting, an outermost part of the cylinder 9 briefly dips down below a circular circumferential line of the impression cylinder 8 and into the cylinder gap 17.

During the further pivoting of the cylinder 9 along the travel path 9*c*, the cylinder 9 leaves the cylinder gap 17 again and reaches the clearance position 9*d*, whereat the pivoting movement of the cylinder 9 terminates. The pivoting of the cylinder 9 out of the initial position 9*a* or 9*b* thereof into the clearance position 9*d* takes place in a rotational direction 25 which is opposite to a rotational direction 26 of the cylinder 8 during the transport of the print carrier 6 by the cylinder 8. In the clearance position 9*d*, the clearance D between the circular circumferential lines of the cylinders 8 and 9 is greater by a multiple than in the print-off position 9*b* of the cylinder 9. The cylinder 9 can be retained and, for example, locked in the clearance position 9*d* by a suitable securing device 24.

The print carrier 6 held in the grippers 3 can then be transported, due to the rotation of the cylinder 8 again by the aforementioned motor, through the printing nip, enlarged to the clearance D, between the cylinders 8 and 9, without any risk of the print carrier 6 impacting the cylinder 9. This operating mode is selected when it is necessary to print the print carrier 6 in the printing units 2 to 5 of the machine 1 and thereafter convey it through the inactive varnishing unit 7, without varnishing the print carrier 6 in the latter.

When the cylinder 9 is to participate in the processing of a print job which follows the print job without varnishing, the securing device of the cylinder 9 can be released, so that the latter can be pivoted counterclockwise about the joint 21 along the travel path 9*c* back into the initial position thereof. The initial position may be the print-on position 9*a* or the print-off position 9*b*. When the cylinder 9 is being pivoted back, it once again dips briefly into the cylinder 8.

The other exemplary embodiment shown in FIG. 3 is described hereinbelow.

Like reference numerals are used in FIGS. 2 and 3 for functionally and structurally identical components.

In the exemplary embodiment of FIG. 3, the cylinder 9 can be displaced out of a print-on position 90*a* or preferably a print-off position 90*b* by a bearing support 27 along a linear travel path 90*c* into a clearance position 90*d* towards the roller 13. For guiding this displacement of the cylinder 9, the bearing support 27 is arranged on the stand 22 of the machine 1. The bearing support 27 is constructed as a linear guide and allows a rotary joint 29, about which the cylinder 9 rotates during varnishing, to be reciprocated between the cylinder 8 and the roller 13. The travel path 90*c* may correspond to an extension or prolongation of a radial line of the cylinder 8 or of the roller 13, the radial line being directed towards the center of the cylinder 8 or the roller 13.

The roller 13 is mounted in a mounting support 30 constructed as a rotary joint, about which the roller 13 rotates during varnishing, and fastened to the stand 22, so that the roller 13 maintains the fixed position thereof unchanged during the displacement of the cylinder 9.

A securing device 31 serves for retaining the cylinder 9 in a rotary position, wherein a circumferential cylinder gap 32 of the cylinder 9 is directed away from the cylinder 8 and towards the roller 13. The securing device 31 is attached to the mounting support 27 and may be constructed as a locking device or a clamping device. In the example shown, the securing device 31 includes a bore formed in the cylinder 9, and a pin insertable into this bore, the pin being arranged displaceably on the mounting support 27.

Clamping devices 33 and 34 for holding a cylinder dressing 35, for example, a blanket or a printing or varnishing plate, on the cylinder 9 are arranged in the cylinder gap 32. The cylinder gap 32 extends over the length of the body of the roller 13 in a direction axially parallel to the cylinder 8 and the roller 13.

The exemplary embodiment shown in FIG. 3 functions as follows:

Initially, the rotation of the cylinder 9 is stopped, so that the cylinder gap 32 is directed towards the roller 13 which is often also designated as a supply cylinder. The cylinder 9 is thereafter secured in the rotary position thereof by the securing device 31. Next, the cylinder 9 is displaced out of the initial position 90*a* or preferably 90*b* thereof, in the direction of the roller 13 along the travel path 90*c*, into a clearance position 90*d*. In the clearance position 90*d*, a circumferential clearance D between the cylinders 8 and 9 is greater by a multiple than a circumferential clearance B when the cylinders 9 are in the print-off position 90*b*. Moreover, with the cylinder 9 displaced into the clearance position 90*d*, the roller 13 is located partially below a circular circumferential line (ideally in the region of the cylinder gap 32) of the cylinder 9 and within the cylinder gap 32 between the clamping devices 33 and 34. As a result of the displacement of the cylinder 9 in the direction of the roller 13, the cylinder gap 32 is slipped over the roller 13 which thus penetrates into the cylinder gap 32.

When the cylinder 9 is in the clearance position 90*d*, there is no longer any risk that a sheet-like print carrier 6 already printed in the printing units 2 to 5 and transported past the cylinder 9 by the rotating cylinder 8 will impact the cylinder 9 with the trailing edge thereof projecting somewhat from the cylinder 8 due to the flexural resistance of the print carrier 6 and centrifugal force, when only the printing units 2 to 5 and not the varnishing unit 7 are used in the in-line process for printing. The printing nip between the cylinders 8 and 9, through which the print carrier 6 is transported by the cylinder 8, corresponds to the sufficient clearance D.

So that the cylinder 9 can be used again for varnish application in a print job which follows a print job without varnishing and which, in addition to the printing of the print carrier 6 in the printing units 2 to 5, also requires varnishing of the print carrier 6 in the varnishing unit 7, the cylinder 9 merely needs to be displaced back into the initial position 90*a* or 90*b* thereof along the travel path 90*c* by the bearing support 27, and the securing device 31 to be released, so that the cylinder 9 can be rotated again about the joint corresponding to the bearing support 30.

We claim:

1. A method for adjusting a cylinder in a printing machine, which comprises:

rotating a second cylinder about a rotational axis;

rotating a first cylinder into a rotary position with a cylinder gap formed in the first cylinder being directed towards the second cylinder of the printing machine; and displacing one of the cylinders, with the second cylinder dipping into the cylinder gap.

2. A method for adjusting a cylinder in a printing machine, which comprises, in a first step, rotating a first cylinder into a rotary position with a cylinder gap formed in the first cylinder being directed towards a second cylinder of the printing machine and, in a second step, displacing one of the two cylinders, with the second cylinder dipping into the cylinder gap and pivoting the second cylinder out of a first cylinder position located outside the cylinder gap, through the cylinder gap, and into a second cylinder position located outside the cylinder gap.

3. The method according to claim 2, wherein, in the second step, the pivoting of the second cylinder takes place about an axis of rotation of a supply roller.

4. The method according to claim 2, wherein the first cylinder is an impression cylinder, and the second cylinder is an applicator cylinder.

5. A method for adjusting a cylinder in a printing machine, which comprises, in a first step, rotating a first cylinder into a rotary position with a cylinder gap formed in the first cylinder being directed towards a second cylinder of the printing machine and, in a second step, displacing one of the two cylinders, with the second cylinder dipping into the cylinder gap and displacing the first cylinder in a direction towards the second cylinder.

6. The method according to claim 5, wherein the first cylinder is an applicator cylinder, and the second cylinder is a supply roller.

7. A printing machine including an impression cylinder formed with a cylinder gap, and an applicator cylinder for applying ink or varnish onto a print carrier transported on the impression cylinder, comprising a bearing support whereon the applicator cylinder is mounted for displacing the applicator cylinder into the cylinder gap, and out of the cylinder gap again into a clearance position wherein it is disposed with a clearance relative to the impression cylinder.

8. The printing machine according to claim 7, wherein said bearing support is formed as a pivot bearing for pivoting the applicator cylinder about a rotational axis of a supply roller for supplying ink or varnish to the applicator cylinder.

9. The printing machine according to claim 7, wherein said bearing support is formed as a pivot bearing for pivoting the applicator cylinder about said pivot bearing into said clearance position in a rotational direction which, as viewed in the rotational direction, is opposite to a rotational direction of the impression cylinder during the transport of the print carrier by the impression cylinder.

10. A printing machine including an applicator cylinder for applying one of ink and varnish, respectively, to a print carrier and, a supply roller for supplying the one of ink and varnish, respectively, to the applicator cylinder, comprising a first bearing support whereon the applicator cylinder is mounted for displacing the applicator cylinder in a direction towards the supply roller, a second bearing support whereon the supply roller is mounted for holding the supply roller in a fixed position during the displacement of the applicator cylinder, and a securing device assigned to the applicator cylinder for retaining the applicator cylinder in a rotary position wherein a cylinder gap formed in the applicator cylinder is directed towards said supply roller.

11. A printing machine including an applicator cylinder for applying one of ink and varnish, respectively, to a print carrier and, a supply roller for supplying the one of ink and varnish, respectively, to the applicator cylinder, comprising a first bearing support, formed as a linear guide, whereon the applicator cylinder is mounted for displacing the applicator cylinder in a direction towards the supply roller, and a second bearing support whereon the supply roller is mounted for holding the supply roller in a fixed position during the displacement of the applicator cylinder.

* * * * *